US009173434B2

(12) United States Patent
Yoo

(10) Patent No.: US 9,173,434 B2
(45) Date of Patent: Nov. 3, 2015

(54) 21 CENTURY UNDERWEAR FOR MEN

(71) Applicant: Jin-Kul Yoo, Seoul (KR)
(72) Inventor: Jin-Kul Yoo, Seoul (KR)

( * ) Notice: Subject to any disclaimer, the term of this patent is extended or adjusted under 35 U.S.C. 154(b) by 0 days.

(21) Appl. No.: 14/397,491
(22) PCT Filed: Sep. 24, 2012
(86) PCT No.: PCT/KR2012/007661
§ 371 (c)(1),
(2) Date: Oct. 28, 2014
(87) PCT Pub. No.: WO2013/176347
PCT Pub. Date: Nov. 28, 2013

(65) Prior Publication Data

US 2015/0082519 A1 Mar. 26, 2015

(30) Foreign Application Priority Data

May 23, 2012 (KR) ..... 10-2012-0055069

(51) Int. Cl.
*A41B 9/02* (2006.01)

(52) U.S. Cl.
CPC . *A41B 9/023* (2013.01); *A41B 9/02* (2013.01); *A41B 2400/20* (2013.01)

(58) Field of Classification Search
CPC ..... A41B 9/02; A41D 1/06; A41D 1/08
USPC ..... 2/403, 405, 227, 228, 238; 602/67, 70
See application file for complete search history.

(56) References Cited

U.S. PATENT DOCUMENTS

| | | | | |
|---|---|---|---|---|
| 6,245,036 | B1 * | 6/2001 | McRoberts et al. | 602/67 |
| 6,862,746 | B2 * | 3/2005 | Cym et al. | 2/403 |
| 7,788,739 | B1 * | 9/2010 | Della Ratta | 2/403 |

FOREIGN PATENT DOCUMENTS

| | | | |
|---|---|---|---|
| JP | 2010265555 | A | 11/2010 |
| JP | 4801218 | B1 | 10/2011 |
| KR | 100813383 | B1 | 3/2008 |
| KR | 2011-0068748 | A | 6/2011 |

OTHER PUBLICATIONS

International Search Report, Feb. 22, 2013, from International Phase of the instant application.

* cited by examiner

*Primary Examiner* — Tejash Patel
(74) *Attorney, Agent, or Firm* — Jackson Patent Law Office

(57) ABSTRACT

The present invention relates to underwear for men. Information that it is good to maintain the underbody (genital organs) of men cool have been already been attested in scientific theses of foreign universities. It has been proved that the spermatogenic ability of men (genital organs) is further higher in an environment lower by 2 to 4 Celsius than body temperature. However, despite the above-mentioned scientific evidence, underwear for men up to now has been produced in the same simple shape for protection against the outside without distinction from underwear for women. The present invention relates to 21 century underwear for men which is different from conventional underwear for men and which causes improvement in skin health and reproductive ability in a sanitary and health manner. The 21 century underwear for men of the present invention was invented to accomplish the following two purposes: first, separating the genital organ area (testicles) of men from the groin area (thigh) so as to keep skin healthy from eczema and avoid the influence of body temperature, and second, forming ventilation openings at least in three directions under the genital organ (testicles) of men so as to keep the genital organ area further cool and to thus healthily and naturally (without chemicals) improve the reproductive ability of men. That is, the present invention is novel 21 century underwear for men which 1) prevents skin disease such as eczema which may be commonly caused between the groin and scrotum of men and separates the genital organ and the body (thigh) area so as to separate the genital organ from the body heat, and 2) forms ventilating openings in three or more directions to enable constant ventilation in the genital organ area and to maintain a more sanitary and cool environment, thus providing further good influences to the reproductive ability of men.

5 Claims, 1 Drawing Sheet

Drawing 1
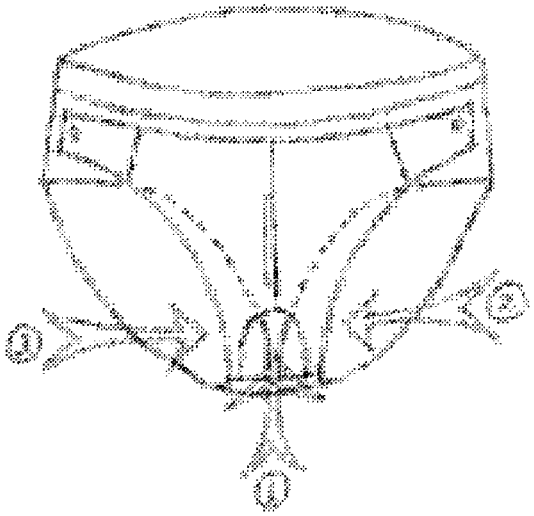
Drawing 2
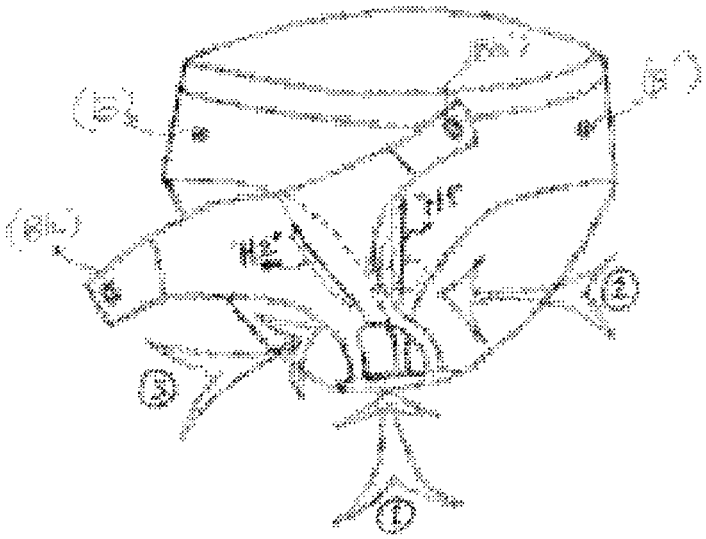

21 CENTURY UNDERWEAR FOR MEN

TECHNICAL FIELD

This invention is about new underwear for the 21st century differentiated from conventional men's underwear, and is a more hygienic and healthier 21 Century Underwear for Men invented to solve two different objectives to improve men's reproductive ability to be healthy by First: dividing male genitals (penis+scrotum) from body (groin) for skin health by minimizing skin diseases such as eczema, Second: maintaining male genitals cooler than wearer's body (body temperature) by situating a vent for ventilation between male genitals and groin.

BACKGROUND TECHNOLOGY

This invention is about men's underwear for men which are certainly distinguished from women's. In detail, underpants (underwear) should be manufactured to keep men's body pleasant and cool always by dividing genitals (penis+scrotum) from the body (groin) to prevent direct contact and friction, and maintain male genitals cool.

DETAILED DESCRIPTION OF THE INVENTION

Technical Task

Unlike women's underwear, men's underwear shall be manufactured to be cooler and more pleasant by dividing genitals from body (thigh) for maintaining ventilation, but have manufactured and put as a closed all-in-one type same as women's underwear so far.

Method to Solve the Task

To solve problems of conventional men's underwear, this invention, as described in the above, intends to solve two (2) different problems of conventional underwear by First: dividing genitals part from body (thigh: groin) part in men's underwear and Second: is manufactured to have a vent for ventilation.

Effect of the Invention

When a man puts on this underwear, he will be able to ① prevent skin problems in advance as genitals and groin are separated and ② maintain genitals in a pleasant and cool environment as ventilation is made through a vent. In that regard, this invention is considered a new and healthy 21 Century Underwear for Men that gives a certain help to improvement of men's reproductive ability as scientifically proven (It is good to maintain temperature 2~4 degrees lower than body temperature for genitals.).

BRIEF DESCRIPTION OF DRAWING

Examples of execution are described with attached drawing.

This invention, 21 Century Underwear for Men is manufactured to have dual spaces to, First: make the front part of underwear have dual spaces for dividing genitals from body (groin), and Second: vent for ventilation in three places from the bottom part of urine hole to the groin part.

<*However, this invention is completed as in the attached drawing by using the minimum quantity of fabric for the front part (fabric of the body side) for the purpose to divide male genitals from the body, and selecting dual-fabric for the optimized design of the vent in the bottom part not to an obstacle to ventilation.>

As an example of execution showing the image of a finished product of this invention '21 Century Underwear for Men' Drawing 1' shows "The front of a finished product-cross-sectional drawing" and as for the fabric of the front of underwear, the back side fabric and both sides of waist part are connected by buttons to divide genitals from the body, and finished to have three vents (Bottom: ① and ②, ③ on each side) at the bottom of urine hole.

'Drawing 2' is an example of execution showing opened status after dividing the front side fabric from the back side fabric which was closed in the 'Drawing 1', and by dividing buttons (B and B') on each side of waist part of underwear from button holes (Bh and Bh'), First: When the underwear is put on: It is able to find that male genitals (penis+testis) are situated at the center in between urine hole ("H1") of back side fabric and urine hole ("H2") of front side fabric, which shows that male genitals is isolated from wearer's body (groin), and Second: When the underwear is put on: As described above, the drawing is an example of execution for description, showing two different effects of the invention '21 Century Underwear for Men' as existence of three vents (① at the bottom and ②, ③ on each side) and effectiveness are identifiable.

Meanwhile, it is also able to change the design of back side fabric and front side fabric of this invention '21 Century Underwear for Men' to a different shape, or transform the shape to boxers different from briefs herein, and the part which will play a role of a vent or ventilating opening between the bottom of urine hole and body (groin) can be transformed to a detachable type or manufactured by changing ((triangle, quadrangle, circle or oval) the shape of vent. A finished product can be manufactured in various methods and shape as in the 'Second or third example of execution', but descriptions and examples of execution of drawing are omitted in this document.

The Best Shape for Implementation of the Invention

It is suggested to see the attached "Brief Description of Drawing: (1)—Example of execution" as a desirable example of execution of this invention.

Shape for Implementation of the Invention

See the above "The Best Shape for Implementation of the Invention".

INDUSTRIAL USABILITY

From the time men started to wear underwear, this new healthy and hygienic underwear which can be substituted for unchanging conventional close (all-in-one) type underwear provides men with a pleasure environment and will be selected by all healthy men as a new product everyone prefers as the 21 Century Underwear for Men which is surely effective for improvement of reproductive ability, the basis of all men.

The invention claimed is:

1. A men's undergarment comprising:

a first fabric section, the first fabric section defining a waist aperture, a left leg aperture, and a right leg aperture; and a second fabric section attached over the first fabric section, the second fabric section defining a first ventilation aperture that overlaps the left leg aperture and overlaps the right leg aperture, the first and second fabric sections being configured to situate male genitals between the first and second fabric sections, thereby isolating the male genitals from a body of a wearer, the first and second fabric sections together defining a second ventilation aperture, the second ventilation aperture being situated between the left leg aperture and the second fabric section, and the first and second fabric sections together defining a third ventilation aperture, the third ventilation aperture being situated between the right leg aperture and the second fabric section.

2. A men's undergarment in accordance with claim 1 wherein the first fabric section includes a first engagement structure, and the second fabric section includes a second engagement structure, and the second fabric section is removably attached to the first fabric section via the second and first engagement structures.

3. A men's undergarment in accordance with claim 2 wherein the first engagement structure includes a button and the second engagement structure includes a button hole.

4. A men's undergarment in accordance with claim 1 wherein the first fabric section defines a urine aperture above the first ventilation aperture.

5. A men's undergarment in accordance with claim 4 wherein the second fabric section defines a urine aperture overlapping the urine aperture of the first fabric section.

* * * * *